US005778814A

United States Patent [19]

Taylor

[11] Patent Number: 5,778,814

[45] Date of Patent: Jul. 14, 1998

[54] SAILBOAT SAIL ARRANGEMENT AND GOOSENECK DEVICE THEREFOR

[76] Inventor: Sarah Louise Taylor, 230-29th St., Avalon, N.J. 08202

[21] Appl. No.: 799,127

[22] Filed: Feb. 13, 1997

[51] Int. Cl.[6] ..... B63B 15/00

[52] U.S. Cl. ..... 114/97

[58] Field of Search ..... 114/39.1, 97, 98, 114/89, 90, 102, 103, 99

[56] References Cited

U.S. PATENT DOCUMENTS

| | | | |
|---|---|---|---|
| 4,473,021 | 9/1984 | Aronowitsch et al. | 114/89 |
| 4,682,557 | 7/1987 | Magruder et al. | 114/98 |
| 4,864,949 | 9/1989 | Olsen | 114/102 |

*Primary Examiner*—Ed L. Swinehart
*Attorney, Agent, or Firm*—William Squire

[57] ABSTRACT

A sunfish boat boom is slidably secured to a pipe tee for aft and bow relative motion to the tee which is secured to the mast by a conventional gooseneck device. A bungee cord secured to the boom at a pulley medial the boom between the mast and the aft end of the boom and to an eyelet at the pipe tee resiliently biases the boom in the bow direction. A rope is secured at its opposite ends to the bow end of the boom passing through an eyelet at the tee and to a cleat at the pilot compartment. Rings on the boom establish maximum aft and bow displacement of the boom via abutment with the tee. The rope holds the boom at an extreme forward position with the tee abutting one of the rings. The rope is released to permit the bungee cord bias to pull the boom to the other extreme aft position established by the other ring abutting the tee. Pulling or releasing the rope moves the boom to any desired position between the extreme positions. The boom is displaced relative to the mast to position the sail for optimum boat speed in tack and reach conditions.

20 Claims, 2 Drawing Sheets

SAILBOAT SAIL ARRANGEMENT AND GOOSENECK DEVICE THEREFOR

This invention relates to gooseneck devices for attaching a boom to a mast in a sailboat.

Small sailboats, sometimes referred to as sunfish, have a single mast and a boom movably attached to the mast. The sail at its lower edge is attached to the boom in conventional fashion and at its uppermost edge to the mast by a pulley arrangement. A so-called gooseneck device attaches the boom to the mast. The gooseneck device comprises a ring and an integral clamp fixed to the ring. The mast passes through the ring to permit the boom to be raised and lowered along the mast to thereby raise and lower the sail. Also, the ring permits the boom to rotate about the mast to permit the boom position to be changed for various tack, run and reach conditions encountered by the boat.

The gooseneck clamp fixed to the ring secures the gooseneck to the boom at a fixed desired location along the boom. In a book by Will White entitled *The sunfish Book*, the author states that the gooseneck position fore and aft has a relationship to wind conditions. The position of the gooseneck relative to the boom affects the center of forces induced by the sail during tack and reach conditions.

Normally, during a race, it is not convenient to relocate the gooseneck for specific wind conditions. The sunfish is typically operated by an individual sailor. The sailor needs to keep a hand on the tiller to control the boat steerage. It is not generally convenient and difficult for the individual to loosen the gooseneck clamp on the boom to relocate the gooseneck position on the boom to optimize the position according to changing wind conditions. As a result, the sailor tends to normally set the gooseneck position to what is believed to be an optimum location on the boom. However, this is not satisfactory for all wind conditions.

The present inventor recognizes a need for a gooseneck device and sail arrangement which permits the sailor to change the relative position of the gooseneck with one hand while at the same time maintaining a grip on the tiller with the other hand.

A sail arrangement according to the present invention for a sailboat having a sail, a deck and a mast extending from the deck for securing the sail thereto comprises a boom having opposing ends, the boom including means for attaching the sail thereto. First means are included for movably attaching the boom to the mast for displacement in vertical and rotational directions relative to the mast. Second means are included for movably attaching the boom for selective displacement of the boom in opposing directions relative to the mast transverse the vertical direction with one hand of a sailor.

In one embodiment, the second means comprises bias means for resiliently biasing the boom in a first of the opposing transverse directions and boom displacement means coupled to the boom for selective displacement of the boom in a second transverse direction opposite the first transverse direction by the one hand.

In a further embodiment, the second means comprises boom attachment means coupled to the first means and to the boom for slidably engaging the boom for permitting the boom displacement in the opposing directions.

A gooseneck device according to the present invention for coupling a sail boom to a mast in a sail boat comprises a ring member for receiving the mast therethrough, the ring member for traversing the mast in a vertical direction and for rotating about the mast. A tubular member is secured to the ring member for slidably receiving the boom, the boom for traversing along the tubular member in a direction transverse the vertical direction. Means are included for securing the ring member to the tubular member.

In a still further embodiment, a sail arrangement for a sailboat having a sail, a deck and a mast extending from the deck for securing the sail thereto comprises a boom having opposing ends, the boom including means for attaching the sail thereto. A gooseneck device is included and comprises a first ring member, the mast for passing through the first ring member, the first ring member for traversing the mast in a vertical direction and for rotating about the mast. A second ring member is secured to the first ring member for slidably receiving the boom, the second ring member for permitting the boom to traverse along the second ring member in a direction transverse the vertical direction relative to the mast. Bias means are provided for resiliently biasing the boom in a first transverse direction relative to the mast. Boom displacement means are coupled to the boom for selective displacement of the boom relative to the mast in a second transverse direction opposite the first direction.

IN THE DRAWING

Figure 1:
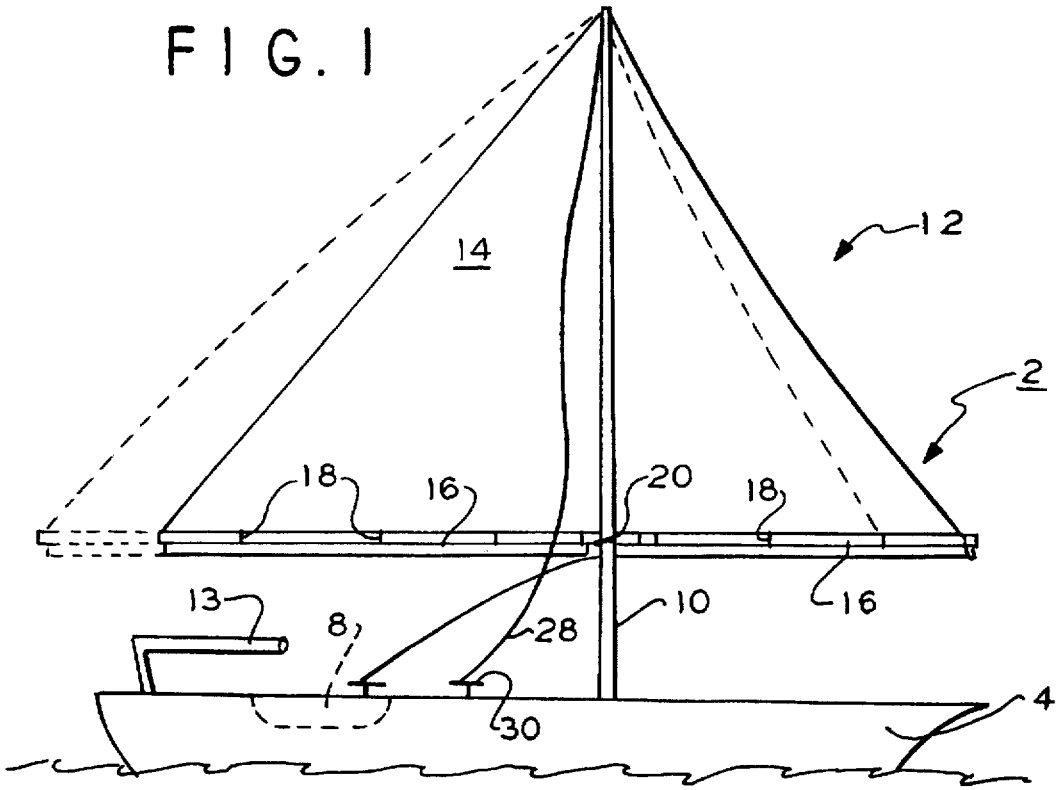
FIG. 1 is a side elevation view of a sailboat including a sail arrangement according to one embodiment of the present invention.
Figure 2:
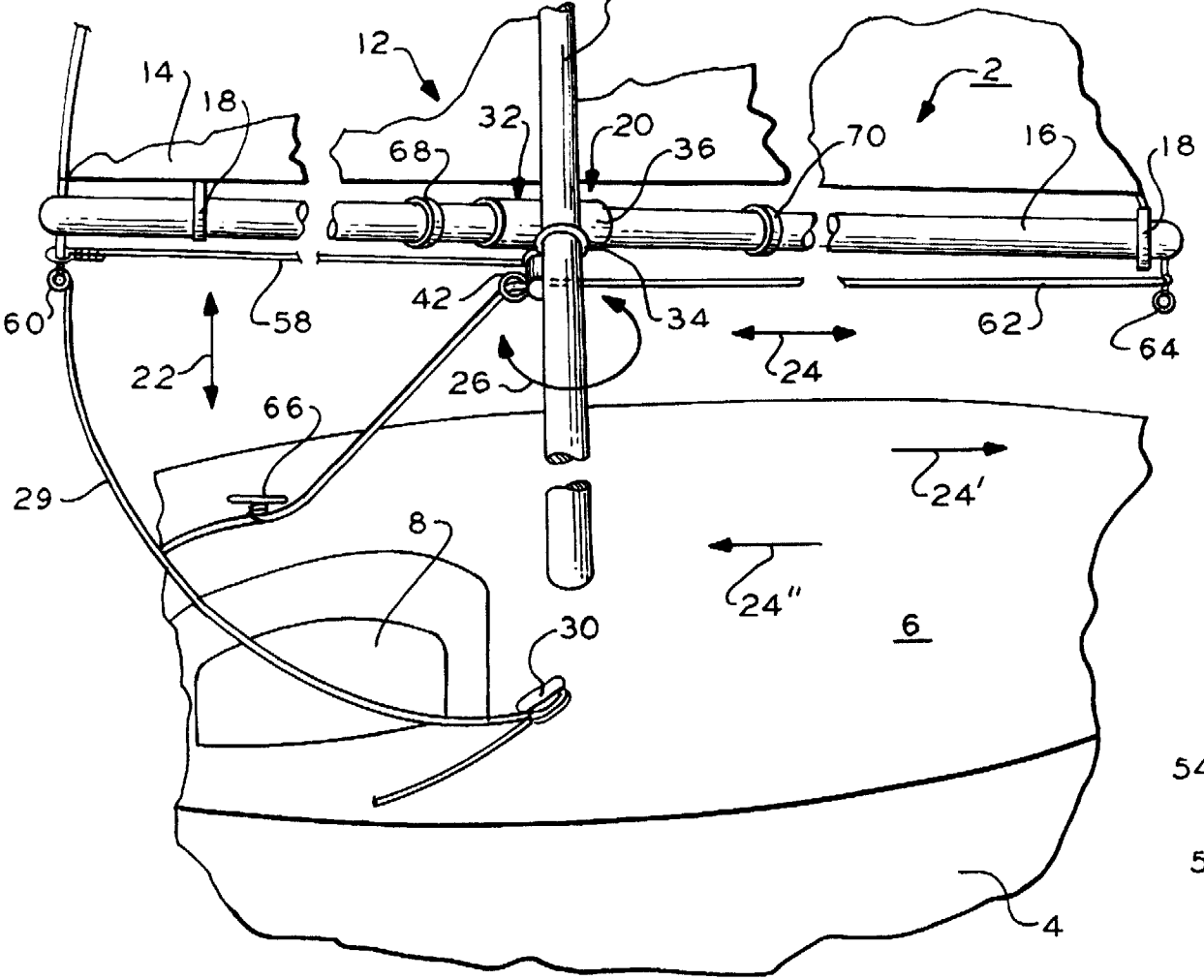
FIG. 2 is a perspective view of a portion of the sailboat of FIG. 1 illustrating the connection of the boom to the mast according to an embodiment of the present invention.

In FIGS. 1 and 2, boat 2, preferably a sunfish, comprises a hull 4, a deck 6, a pilot compartment 8, a mast 10 secured to deck 6, and a sail assembly 12. A rudder not shown is controlled by a tiller 13. The assembly 12 comprises a conventional sail 14, generally triangular, a spar or boom 16, a forward spar, a plurality of sail clips 18 for attaching the sail to the boom 16 and forward spar, an eyelet (not shown) at the top of the mast 10 for raising and lowering the sail via sheet line 28, and various pulley arrangements (not shown) for the sheet line 28 for raising and collapsing the sail 14.

The assembly 12 also includes a gooseneck device 20 according to the present invention for movably attaching the boom to the mast for selective displacement of the boom 16 in vertical directions 22, directions 24 transverse the vertical directions 22 and rotational directions 26 about the mast 10.

A halyard 28 is used to raise and lower the sail via an eyelet (not shown) at the top of the mast 10. The halyard 28 is fastened to a cleat 30 adjacent to compartment 8.

Figure 3:
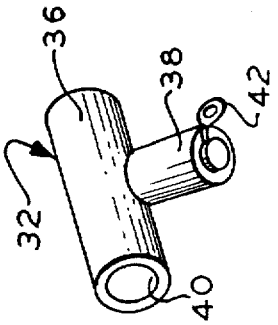
FIG. 3 is an isometric view of a portion of the gooseneck device of FIG. 2.

The boom 16 is conventional and is typically an elongated wood or metal cylindrical member. Gooseneck device 20, FIGS. 3 and 4, in this embodiment, preferably comprises a commercially available polyvinylchloride (PVC) plumbing tee 32 and a gooseneck 34. The tee 32, comprises a length of a tubular pipe-like body 36, and a tubular shank 38 normal to the length dimension of the body 36. The shank 38 has a smaller diameter than that of the body 36. The body 36 and shank 38 may have any desired corresponding length according to a given implementation. The body 36 has a bore 40 for loosely receiving the boom 16 so that the boom can easily axially slide in the bore 40 in bow-aft directions 24.

Figure 5:
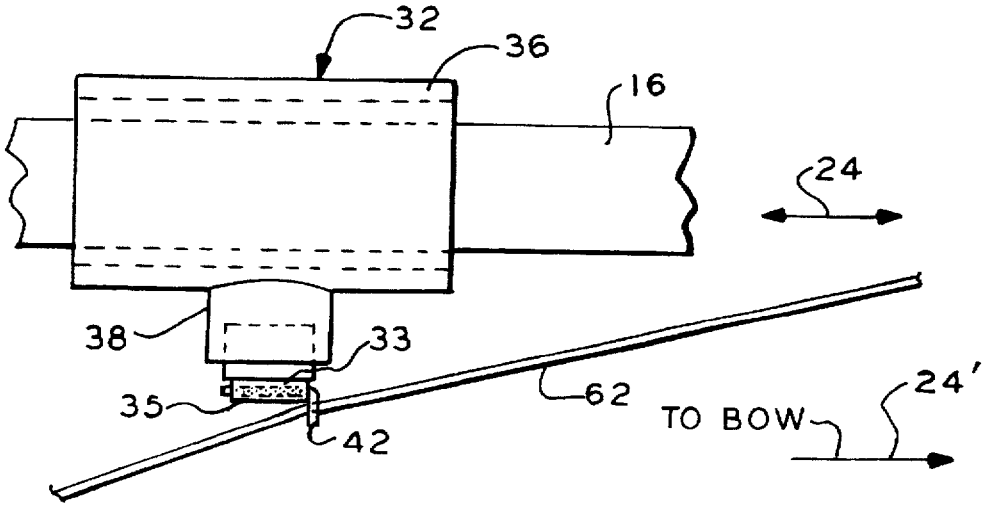
FIG. 5 is a side elevation view of a gooseneck element used in the embodiment of FIG. 2.

The tee 32 is preferably formed in this embodiment as a one piece integral unit by molding the shank 38 with the body 36 and is commercially available in this configuration. In FIG. 5, a plug 33, which may be thermoplastic, is bonded to the bore of the shank 38. The plug 33 has a stepped cylindrical portion 35 of reduced diameter. An eyelet 42 is threaded through the plug 33 step portion 35 extending beyond the shank 38.

Figure 6:
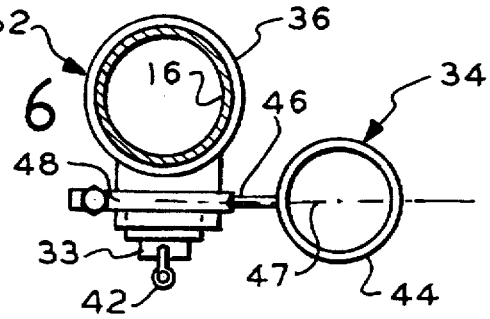
FIG. 6 is an end view of the gooseneck device of the embodiment of FIG. 2.
Figure 4:
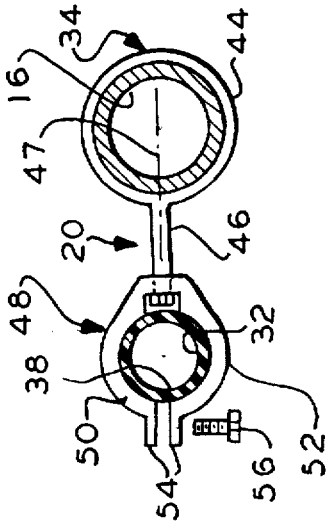
FIG. 4 is a plan sectional view of the gooseneck device of FIG. 2.

The gooseneck 34, FIGS. 4 and 6, is conventional and comprises a metal ring 44 through which the mast 10 passes. The ring 44 is loosely fitted about the mast to permit the ring 44 to move axially in direction 22 parallel to the mast longitudinal axis and annularly in direction 26 about the mast, FIG. 2. A connecting link 46 is fixed to the ring 44. The link 46 is a circular cylindrical rod which is rotatably connected to the clamp 48. The clamp 48 and thus the tee 32 and boom 16 can rotate about the longitudinal axis 47 of the link 46 which axis is normal to the mast longitudinal axis.

The link 46 shank has a threaded end which passes through a bore in the clamp 48. The threaded end connects the link to the clamp with a nut. Clamp 48 has opposing halves 50, 52 each with a flange 54. The flanges 54, and halves 50, 52, are clamped together by a bolt 56. The halves 50, 52 clamp the tee 32 shank 38 therebetween. The tee 32 is thus secured in rotatable relation to the gooseneck 34 for rotation about axis 47 and to the mast for rotation about the mast longitudinal axis.

A resilient rope-like member 58, FIG. 2, such as a commercially available bungee cord, is secured at one end fixed to the fixed portion of sheet line 29 pulley 60. The sheet line pulley 60 is fixed medially of the boom 16 for use with the sheet line 29 for adjusting the boom angular position about the mast 10 in a conventional manner. The sheet line is connected to cleat 31. The other opposite end of the member 58 is fixed to the eyelet 42 attached to the tee 32 shank 38 or, in the alternative, to gooseneck 34 by a fastener (not shown) or by wrapping about the shank 38 and so on, by way of example. The resilient elongated cord-like member 58 is normally in tension so that the boom 16 is always resiliently biased in the aft direction 24" of directions 24. This locates the tee 32 and mast 10 relative to the boom 16 in the most forward bow direction 24' of directions 24.

A rope 62 is fixedly attached at one end to the boom 16 via eyelet 64 at the forward bow end of the boom 16. The rope 62 medial section passes through eyelet 42 attached to tee 32 of gooseneck device 20 and terminates at cleat 66, FIG. 2. The cleat 66 releasable secures that end of the rope 62 to the deck 6. Since the cleat 66 is aft of the mast, the rope traverses a path to the bow end of the boom 16 which path does not pass through sharp bends. Such sharp bends might add resistance which tends to inhibit moving the rope through the eyelet 42. For example, such a sharp bend would be encountered if the rope 62 boom end at eyelet 64 were attached instead to the aft end of the boom 16 and the resilient member 58 attached to the eyelet 64 at the bow end of the boom in a reversal of the present configuration.

While such a reversal configuration is operative, it is believed the present embodiment is easier to operate. The rope 62 is secured to cleat 66 adjacent to the pilot compartment 8. The rope 62 is so secured so that it exhibits tension induced by the resilient member 58 which is also in tension as described above. The rope 62 thus holds the boom 16 in its assigned relative position in directions 24 with respect to the gooseneck device 20 and mast 10.

Secured to and about the boom 16 are a pair of spaced elastomeric rings 68 and 70. These rings may be rubber for example. The rings are releasable secured to the boom 16 by their friction engagement with the boom. The rings 68 and 70 set the extreme aft (direction 24") and bow (direction 24") positions of the boom 16 relative to the gooseneck device 20 and mast 10. The rings 68 and 70 are manually adjustable along the boom 16 to set the desired extreme positions of the boom 16. These positions are predetermined for optimum tack and reach positions of the boom for a given set of wind conditions.

Different wind speeds require different maximum boom positions for a given tack or reach condition corresponding to such wind speeds. These boom positions maximize the speed of the boat 2 accordingly. In a tack condition, to maximize boat speed, the gooseneck device 20 should be placed most forward toward the bow relative to the boom 16, direction 24' (or the boom most aft toward the stern direction 24"). In a reach condition, to maximize boat speed, the boom extreme positions should be reversed. That is, the gooseneck device 20 should be most aft relative to the boom 16 (or the boom most forward toward the bow).

The relative position of the boom 16 to the gooseneck device 20 also changes the relative angle of attack of the air on the forward or bow facing top edge of the sail. Because of the relatively fixed position of the prior art gooseneck with respect to the boom during a sailing mode and the difficulty in changing its position, especially by a lone sailor, these relative positions can not be readily changed during the course of a race to optimize the speed of the boat.

In operation, the position of the rings 68 and 70 on the boom are set according to expected wind conditions during a given sailing period. The boom is normally held in its most aft position (the device 20 is in its most forward relative position to the boom) against the bias of resilient member 58 by the secured rope 62. In this position, the tee 32 body 36 (FIG. 3) abuts the forward ring 70. This is the tack position of the boom.

The relative position of the boom is adjusted forwardly direction 24' for initial sailing conditions by selective releasing the rope 62 from its secured fixed mooring on cleat 66 in desired increments.

The member 58 pulls the boom in forward direction 24' opposite the direction 24" in response to the bias upon release of the rope. The rope 62 is then secured when the desired boom 16 position is obtained. Thus, the release of the rope causes the bias to automatically pull the boom forward toward the bow direction 24' (to the right in FIG. 2) relative to the gooseneck assembly 20 and mast 10, toward the reach position.

This pulling action is completed with one hand on the rope 62, the other hand being on the tiller 13. If the rope is released sufficiently, the boom displaces until the ring 68 abuts the tee 32 body 36. In this position, operation in a reach condition is presumed desired and optimizes boat speed.

Should a tack condition then be warranted, to maximize boat speed, the rope 62 is released from its secured position and pulled. The boom is then manually displaced in direction 24" against the bias of member 58 until the ring 70 abuts the bow end of the tee 32 body 36. This places the boom in its most aft position relative to the mast for maximizing tack action.

Should it be desired to place the boom in the intermediate positions of the extremes of rings 68 and 70, it is simply a matter of the rope being secured when the desired boom position is observed by either releasing or pulling on the rope 62 accordingly. In this way with a single hand, the rope 62 and resilient member 58 are utilized to cooperate to position the boom in any desired location relative to the mast. As mentioned previously, the reversal of the member 58 and rope 62 attachments to the boom 16 will also cause the same action.

It will occur that various modifications may be made to the disclosed embodiments without departing from the scope of the invention as defined in the appended claims. For example, while manual means are disclosed for moving the boom relative to the mast, electrical means may also be provide using motor driven rack and gear devices for example. A motor driven gear may be attached to the gooseneck and a rack to the boom or a reversal thereof. The boom may be secured in place with a tube such as body 36 with the rack and gear attached to the tee 32 for example. Also, the tee body need not be tubular. Any suitable arrangment for axially movably securing the boom may be used.

What is claimed is:

1. A gooseneck device for coupling a sail boom to a mast in a sail boat comprising:

a ring member for receiving the mast therethrough, said ring member for traversing the mast in a vertical direction and for rotating about said mast;

a tubular member secured to the ring member for slidably receiving the boom, said boom for traversing along the tubular member in a direction transverse the vertical direction; and means for securing the ring member to the tubular member.

2. The device of claim 1 wherein the tubular member comprises a thermoplastic tube having a bore for receiving said boom therethrough.

3. The device of claim 1 wherein the tubular member is T-shaped having a leg member and a cross member secured to an end of the leg member, said cross member comprising said tubular member for receiving the boom therethrough.

4. The device of claim 3 wherein the leg member comprises a further tube fixedly secured to the cross member and comprising a one piece integral construction with the cross member.

5. The device of claim 4 wherein the tubular member is molded polyvinylchloride.

6. The device of claim 1 wherein the ring is rotatably secured to the tubular member.

7. The device of claim 1 including articulated joint means for connecting the ring and tubular member.

8. The device of claim 1 wherein the means for securing comprises a clamp.

9. The device of claim 1 wherein the means for securing includes means for releasable securing the ring member to the tubular member.

10. The device of claim 1 wherein the means for securing includes means for movably securing the ring member to the tubular member.

11. A sail arrangement for a sailboat having a sail, a deck and a mast extending from the deck for securing the sail thereto comprising:

a boom having opposing ends, said boom including means for attaching the sail thereto;

a gooseneck device comprising:

a first ring member, the mast for passing through the ring member, said ring member for traversing the mast in a vertical direction and for rotating about said mast; and a second ring member secured to the first ring member for slidably receiving the boom, said second ring member for permitting the boom to traverse along the second ring member in a direction transverse the vertical direction relative to the mast;

bias means for resiliently biasing the boom in a first transverse direction relative to the mast; and boom displacement means coupled to the boom for selective displacement of the boom relative to the mast in a second transverse direction opposite the first direction.

12. The sail arrangement of claim 11 including stop means for limiting the magnitude of the displacement of the boom in said first and second transverse directions.

13. The sail arrangement of claim 12 wherein the stop means comprises means secured to the boom at spaced locations along the boom for engaging said second ring member.

14. The sail arrangement of claim 11 including means for movably securing the first ring member to the second ring member.

15. The sail arrangement of claim 14 wherein the second ring member includes a tube for receiving the boom and a shank, said means for movably securing comprises a clamp movably attached to the first ring member for clamping to the shank.

16. The sail arrangement of claim 14 wherein the means for securing comprises a clamp for clamping to the boom and movably attached to the second ring member with an articulating joint.

17. The sail arrangement of claim 11 comprising:

a rope secured to the boom for selective manual displacement of the boom in a direction opposite the first direction.

18. A sail arrangement for a sailboat having a sail, a deck and a mast extending from the deck for securing the sail thereto comprising:

a boom having opposing ends, said boom including means for attaching the sail thereto:

first means for movably attaching the boom to the mast for displacement in vertical and rotational directions relative to the mast; and second means for movably attaching the boom for selective displacement of the boom in opposing directions relative to the mast transverse the vertical direction with one hand of a sailor.

19. The sail arrangement of claim 18 wherein the second means comprises bias means for resiliently biasing the boom in a first of said opposing transverse directions and boom displacement means coupled to the boom for selective displacement of the boom in a second transverse direction opposite the first transverse direction by said one hand.

20. The sail arrangement of claim 19 wherein the second means comprises boom attachment means coupled to the first means and to the boom for slidably engaging the boom for permitting said boom displacement in said opposing directions.

* * * * *